US005360632A

United States Patent [19]

Johnson et al.

[11] Patent Number: 5,360,632

[45] Date of Patent: Nov. 1, 1994

[54] REDUCED LEACHING OF ARSENIC AND/OR MERCURY FROM SOLID WASTES

[75] Inventors: Marvin M. Johnson, Bartlesville, Okla.; Maybin Simfukwe, Houston, Tex.; Gerhard P. Nowack; Donald H. Kubicek, both of Bartlesville, Okla.

[73] Assignee: Phillips Petroleum Company, Bartlesville, Okla.

[21] Appl. No.: 105,208

[22] Filed: Aug. 10, 1993

[51] Int. Cl.[5] ..... B05D 7/00

[52] U.S. Cl. ..... 427/212; 427/221; 427/430.1; 588/249; 588/256

[58] Field of Search ..... 427/212, 221, 430.1; 588/249, 256

[56] References Cited

U.S. PATENT DOCUMENTS

| | | | |
|---|---|---|---|
| 3,476,552 | 11/1969 | Parks et al. | 75/101 |
| 3,576,613 | 4/1971 | Fleming | 71/28 |
| 3,639,222 | 2/1972 | Scheiner et al. | 204/94 |
| 4,017,369 | 4/1977 | Lindström | 204/121 |
| 4,104,350 | 8/1978 | Doss | 264/225 |
| 4,234,632 | 11/1980 | Lubowitz | 427/221 |
| 4,560,502 | 12/1985 | Hackstein et al. | 252/62 H |
| 4,600,610 | 7/1986 | Hrovat et al. | 428/2 |
| 4,636,242 | 1/1987 | Timmons | 71/28 |
| 4,671,882 | 6/1987 | Douglas et al. | 210/720 |
| 4,734,270 | 3/1988 | Touro et al. | 423/29 |

OTHER PUBLICATIONS

"Liquid Polysulfide Polymer" product brochure of Morton International, Chicago, Ill. no date available.

*Primary Examiner*—Shrive P. Beck
*Assistant Examiner*—David M. Maiorana
*Attorney, Agent, or Firm*—K. K. Brandes

[57] ABSTRACT

Solid waste material which contains arsenic and/or mercury impurities is encapsulated in a cured polysulfide polymer so as to alleviate leaching of arsenic and/or mercury into aqueous liquids. Preferably, the solid waste material is first extracted with an alcohol such as ethanol or, alternatively, treated with an oxidizing agent such as aqueous hydrogen peroxide and then substantially dried before the encapsulation with the polymer is carried out.

28 Claims, No Drawings

REDUCED LEACHING OF ARSENIC AND/OR MERCURY FROM SOLID WASTES

BACKGROUND OF THE INVENTION

This invention relates to a method for alleviating the leaching of arsenic and/or mercury from solid waste materials.

Some solid waste materials contain arsenic and/or mercury (either in elemental form or as compounds). Examples of such waste materials are spent sorbent materials (which have been used for removing arsenic and/or mercury impurities from gas streams). When these solid waste materials are disposed of in landfills, As and/or Hg impurities may gradually leach from these materials and contaminate the ground water. The present invention is directed to alleviating the leaching of arsenic and/or mercury impurities from solid waste materials so as to make their disposal in landfills environmentally safer.

SUMMARY OF THE INVENTION

It is an object of this invention to provide a method for encapsulating solid waste materials so as to alleviate the leaching of arsenic and/or mercury impurities therefrom. Other objects and advantages will become available from the detailed disclosure and the appended claims.

A process for encapsulating a solid waste material which contains at least one impurity selected from the group consisting of elemental arsenic, arsenic compounds, elemental mercury and mercury compounds comprises mixing said solid waste material with at least one liquid polysulfide polymer and at least one oxidative curing agent so as to form a mixture wherein said solid waste material is substantially immersed in said liquid polysulfide polymer, and thereafter maintaining the formed mixture at effective polymer curing conditions so as to harden the liquid polymer(s) and to produce a solid encapsulation product (i.e., the waste material encapsulated in the cured, hardened polysulfide polymer, wherein the solid encapsulation product leaches less of said at least one impurity into an aqueous liquid than the unencapsulated solid waste material).

The preferred liquid polysulfide polymer is a polymer of bis-(ethylene oxy)methane which contains disulfide linkages and terminal reactive mercapto (—SH) groups, and has the general chemical formula of $HS(C_2H_4—O—CH_2—O—C_2H_4SS)_x—C_2H_4—O—CH_2—O—C_2H_4SH$, wherein x is a whole number which generally is in the range of about 2 to about 50. Preferred oxidative curing agents, which cause cross linking and hardening of the polysulfide polymer, are manganese dioxide, lead dioxide, calcium peroxide, zinc peroxide, sodium perborate, ammonium dichromate, and cumene hydroperoxide.

In one preferred embodiment of this invention, the solid waste material is first extracted with an alcohol (preferably ethanol) and thereafter substantially dried, before it is mixed with (and immersed in) the liquid polysulfide polymer and the oxidative curing agent, followed by hardening the thus-formed mixture, as has been described above.

In another preferred embodiment of this invention, the solid waste material is first treated with a dissolved oxidizing agent, and thereafter substantially dried, before it is mixed with (and immersed in) the liquid polysulfide polymer and the oxidative curing agent, followed by hardening of the thus-formed mixture, as has been described above. Presently preferred dissolved oxidizing agents are aqueous solutions of hydrogen peroxide or sodium hypochlorite.

DETAILED DESCRIPTION OF THE INVENTION

Any solid waste material (destined for disposal) which contains arsenic and/or mercury can be used as the starting material in the processes of this invention. Preferably, these waste materials are spent sorbent materials which have been used for removing arsines, and generally also mercury, from fluids such as natural gas or olefins. Non-limiting examples are: spent sorbent materials comprising copper oxide, zinc oxide and, optionally, also alumina (described in U.S. Pat. No. 4,593,148); spent sorbent materials comprising copper-(II) chromite (described in U.S. Pat. No. 4,605,812); spent sorbent materials comprising supported silver compounds (described in U.S. Pat. 4,933,159); spent sorbent materials comprising supported gold compounds (described in U.S. Pat. No. 4,971,608); spent sorbent materials comprising manganese dioxide and copper(II) oxide (described in U.S. Pat. No. 4,992,620); spent sorbent materials comprising copper sulfide (preferably $Cu_2S$) on a support material (such as ZnO, $Al_2O_3$ and a mixture thereof, described in U.S. Pat. No. 5,024,683); spent sorbent materials comprising supported iron(III) polysulfides (described in U.S. Pat. No. 5,064,626); spent sorbent materials comprising elemental sulfur on a support material, preferably $S/Al_2O_3$, $S/TiO_2$, $S/SiO_2$ and S/carbon (described in U.S. Pat. No. 5,085,844); spent sorbent materials comprising vanadium pentoxide on a support (described in U.S. Pat. No. 5,096,681); spent sorbent materials comprising Cu-exchanged sulfonate styrene polymers (described in U.S. Pat. No. 5,096,682); spent sorbent materials comprising lead oxide and a support (preferably alumina); spent sorbent materials comprising supported cobalt sulfide and/or supported nickel sulfide and/or supported molybdenum sulfide (wherein alumina is the preferred support); spent sorbent materials comprising supported alkali metal permanganeses (such as $KMnO_4$ on $Al_2O_3$), and the like, and mixtures of two or more than two of the above-described spent arsenic and/or mercury sorbent materials.

A presently more preferred solid waste material is spent $CuO/ZnO/Al_2O_3$ which has been used for removing mercury impurities and/or arsines (in particular $AsH_3$, alkyl arsines, dialkyl arsines and trialkyl arsines) from hydrocarbon fluids (such as natural gas or ethylene or propylene). The fresh $CuO/ZnO/Al_2O_3$ is available from the BASF Corporation, Parsippany, N.J., under the product designation of "R3-12" (which contains about 40 wt. % CuO, about 40 wt. % ZnO and about 20 wt. % $Al_2O_3$).

Another presently more preferred solid waste material is $S/Al_2O_3$ which has been used for removing mercury impurities and/or arsines from hydrocarbon fluids (such as natural gas). Generally, this material contains about 5–30 wt. % elemental sulfur and is commercially available from Phillips Petroleum Company, Bartlesville, Okla. (or its subsidiary, Catalyst Resources, Inc., Bayport, Tex.), under the product designation of "NTT-200". It is within the scope of this invention to use as the solid waste material an alumina material which has been employed in a Claus process (for oxidizing $H_2S$ to elemental sulfur) and thereafter has been employed as a sorbent for removing arsine and/or mercury impurities from hydrocarbon fluids (such as natural gas).

Generally, the solid waste material which is encapsulated by the process of this invention contains about 0.1 to about 10 weight-% As (preferably about 3–5 weight-% As) and about 0.001–0.1 weight-% Hg (preferably about 0.001–0.01 weight-% Hg). The arsenic impurities present in the solid waste material may be elemental As, but are generally present as As compound(s), such as alkyl-substituted arsines, or alkyl-substituted arsine oxides, or arsine sulfides, or arsenic acid, or arsenous acid, or metals salts or esters of these acids, and the like, as has been described in U.S. Pat. No. 4,541,918. The mercury impurities present in the solid waste material may be elemental mercury or compounds of mercury, such as dialkyl mercury compounds or dicycloalkylmercury compounds, diarylmercury compounds or alkylmercury halides, or cycloalkylmercury halides, or arylmercury halites, or mercury(II) arsenides, or mercury sulfates or thiosulfates, and the like.

The particle size, pore volume and surface area off, the solid waste material are not considered critical parameters of this invention and can vary widely (depending on the source of the waste material). Generally, the particle size is in the range of about 0.1 to about 10 mm, the total pore volume is in the range of about 0.1–0.5 cc/g, and the surface area is in the range of about 50–200 $m^2/g$.

Any liquid polysulfide polymer which can be crosslinked and hardened by means of an oxidative curing agent can be used in the process of this invention. The preferred liquid polysulfide polymer has been defined above. Particularly preferred are those commercially available from Specialty Chemicals Group of Morton International, Chicago, Ill., and include (but are not limited to) LP-3, LP-33, LP-977, LP-980, LP-980C, LP-2, LP-32, LP-12 and LP-31. These polymers can be used as single polymers or as mixtures of two or more of these polymers (which may exhibit more desirable flow characteristics than any single polymer). These polymers generally have an average molecular weight of about 1,000 to about 8,000, a mercaptan content of about 1 to about 8 weight-%, a viscosity (at 25° C.) of about 9 to about 1450 poise, and a specific gravity (at 25° C.) of about 1.26 to about 1.32. Presently most preferred are polysulfide polymers having an average molecular weight of about 1,000–2,500, a mercaptan content of about 2.5–6, and a viscosity (at 25° C.) of about 15–150 poise.

Any effective oxidative curing agent which will cause crosslinking and hardening of the polysulfide polymers can be used in the process of this invention. Preferred curing agents have been listed above. Presently most preferred is $MnO_2$. The weight ratio of curing agent to liquid polysulfide polymer depends on the type of polymer, the particular curing agent, the desired curing rate and the like, but generally is in the range of about 1:100 to about 40:100, preferably about 2:100 to about 20:100. Frequently, the curing agent is applied as a paste, which contains a suitable liquid plasticizer agent (e.g., a hydrocarbon oil) and a suitable accelerator (such as water, an amine, an inorganic base, and the like).

The solid waste material, the liquid polysulfide polymer and the curing agent can be combined in any suitable manner. Even though it is feasible to prepare a mixture of all three components in the step, it is frequently more practical to prepare a mixture of the polymer and the curing agent first and then combine this mixture with the solid waste material (which is then submerged in the liquid mixture of polymer and curing agent). One particularly practical method would be to pour a mixture of liquid polymer and curing agent into a metal drum which contains the solid waste material, and then agitate the drum contents so as to achieve adequate mixing of the solid and liquid components. After the entire mixture has hardened, the filled drum is sealed and transported to a landfill for disposal.

The curing (i.e. , cross linking, hardening) of the polysulfide polymer, which contains dispersed therein a curing agent and the solid waste material, can be carried out at any suitable, effective curing conditions which are known to those skilled in the art. Generally, this curing process (in which terminal —SH groups of different polymer chains react with the oxidative curing agent and form —S—S— linkages and water, thus causing an increase in the molecular weight of the polymer) is carried out at a temperature of about 20°–80° C., for a period of time of about 2 to about 100 hours. If, for practical reasons, curing at a relatively low temperature (such as room temperature of about 20°–40° C.) is desired, a relatively long curing time is chosen and/or a greater amount of a suitable accelerator will be employed (as can be determined, without undue experimentation, by those skilled in the art) so as to assure adequate hardening.

In a particularly preferred embodiment of this invention, the solid waste material is extracted (preferably at an elevated temperature, e.g., at reflux conditions, for about 1–50 hours) with a liquid alcohol which generally contains 1 or 2 OH groups and about 1–7 carbon atoms per molecule. Preferred alcohols are aliphatic or cycloaliphatic alcohols such as methanol, ethanol, n-propanol, isopropanol, 1-butanol, 2-butanol, isobutanol, pentanols, hexanols, cyclohexanol, heptanols, glycol and the like, and mixtures thereof. Presently preferred is ethanol. This pretreatment with an alcohol and subsequent drying prior to the encapsulation with the cured polysulfide polymer will generally alleviate As and/or Hg leaching into an aqueous liquid more than encapsulation with the cured polysulfide polymers alone.

In another preferred embodiment of this invention, the waste material is treated with a dissolved oxidizing agent, such as an aqueous solution of hydrogen peroxide (containing about 10–30 weight-% $H_2O_2$) or, alternatively, an aqueous solution of sodium hypochlorite (such as commercially available household bleach), or an aqueous solution of other well known inorganic oxidizing agents (e.g., ammonium or alkali metal peroxodisulfate, ammonium or alkali metal chlorate or perchlorate, ammonium or alkali metal dichromate). Presently preferred are aqueous solutions of $H_2O_2$ and NaOCl, respectively. The pretreatment of the waste material can be carried out at room temperature (20°–30° C.) or at an elevated temperature (generally about 30°–80° C.) for a period of time generally ranging from about 1 hour to about 1 day. This oxidative pretreatment, followed by substantial drying, will have an additional beneficial effect on the alleviation of As and/or Hg leaching into an aqueous liquid after the encapsulation with the cured polysulfide polymer.

The following examples are presented to further illustrate the invention and are not to be considered unduly limiting the scope of this invention.

EXAMPLE I

This example illustrates the procedure of a test approved by the U.S. Environmental Protection Agency (EPA) for simulating the leaching of toxic substances from solid waste materials in sanitary landfills. This test, which has been published as the Toxicity Characteristic Leaching Procedure (TCLP) in the Federal Register, Volume 55, No. 61, 1990, pages 11863–11875, is used in the tests for assessing the leachability of As and Hg impurities from solid materials (described below).

Prior to the extraction, the solid material (which has been ground or cut into pieces) must pass through a 9.5-mm (0.375-inch) standard sieve. The sieved solid material is then extracted at 22° C. for 18 hours with an aqueous acetate buffer solution having a pH of 4.9, at a liquid:solid weight ratio of 20: 1. The extraction test is carried out in an agitation apparatus which is capable of rotating several extraction bottles of 500–600 mL volume (containing the solid waste material and the extraction liquid), in an end-over-end fashion at 30±2 rpm. Suitable extraction equipment is commercially available from Associated Design & Manufacturing Co., Alexandria, Va.; Analytical Testing and Consulting Services, Inc., Warrington, Pa.; Millipore Corporation, Bedford, Mass.; and other companies listed in the published TCLP procedure.

After the extraction, the mixture of solid and extraction liquid is separated by filtration through a 0.6 micron glass fiber filter (available from Millipore Corporation or other suppliers) at a maximum pressure of 50 psi. The solid filter cake is discarded, and the liquid extract is analyzed for As and Hg contents by plasma emission spectrometry. A solid material passes the above-described EPA leaching test if the liquid extract contains no more than 5.0 mg As per liter of the liquid extract and no more than 0.2 mg Hg per liter of the liquid extract, i.e., no more than 5 ppm As and no more than 0.2 ppm Hg. An encapsulated solid waste material obtained by the process of this invention which passes this EPA leaching test is considered safe for disposal in sanitary landfills.

EXAMPLE II

This example illustrates the procedure for the encapsulation of spent arsenic- and mercury-containing sorbent materials with polysulfide polymers, in accordance with this invention. First, about 100 grams of a liquid polysulfide polymer (identified below) and about 20–40 grams of a $MnO_2$ paste (commercially available from Morton International, Chicago, Ill.) were mixed in a blender. Then up to about 100 grams of a spent "NTT-200" arsine sorbent material (described above; containing about 10–30 weight-% sulfur on alumina; having been used in a commercial natural gas field for trimethyl arsine removal) or, alternatively, a spent "R3-12" arsine/mercury sorbent (described above; containing about 40 weight-% CuO, about 40 weight-% ZnO and about 20 weight-% $Al_2O_3$; having been used for purifying commercial olefin streams), each containing about 3–5 weight-% As and about 10–20 ppm Hg, was added to the polymer/$MnO_2$ mixture, followed by thorough mixing in a blender. In the final mixture, the spent sorbent particles were completely submerged in the liquid polymer. This final mixture was kept in a beaker at room temperature for a period of time of about 6–72 hours until it had hardened. The hardened mixture (having attained the cylindrical shape of the beaker) of cured polymer, manganese oxide(s) and spent sorbent was removed from the beaker, and was tested for arsenic and mercury leaching in accordance with the procedure of Example I.

The following two polysulfide polymers (both commercially available from Horton International, Chicago, Ill.) were used for the encapsulation: LP 980C (having a viscosity at 25° C. of 100–150 poise, a mercaptan content of 2.5–3.5%, and an average molecular weight of 2500), and LP 33 (having a viscosity of 15–20 poise, a mercaptan content of 5.0–8.5, and an average molecular weight of 1000). Representative leaching results (obtained in accordance with the procedure of Example I) for encapsulated and unencapsulated (control) As/Hg-containing solid waste materials are summarized in Table I.

TABLE I

| Solid Waste Material | Polysulfide Used for Encapsulation | As (ppm) in Leachate | Hg (ppm) in Leachate |
|---|---|---|---|
| NTT-200 | None | 1890 | N/A[3] |
| NTT-200 | LP-33 | 494 | N/A[3] |
| NTT-200 | LP-33 | 553 | 0.08 |
| NTT-200[1] | LP-33 | 3 | 0.12 |
| NTT-200[2] | LP-33 | 5 | N/A[3] |
| NTT-200 | LP-980C | 190 | N/A[3] |
| NTT-200[2] | LP-980C | 0.3 | 0.26 |
| R3-12 | None | 324 | 0.62 |
| R3-12 | LP-33 | 4 | 0.24 |
| R3-12 | LP-980C | 0.3 | 0.11 |

[1]extracted with ethanol at reflux conditions for 8 hours, and then dried before encapsulation
[2]treated with 30% aqueous $H_2O_2$ at room temperature for about 1 day, and then dried before encapsulation
[3]not determined or not detected.

Test data in Table I clearly show that the encapsulation of As- and Hg-containing solid waste materials, in accordance with this invention, reduced arsenic and mercury leaching. Extraction of the waste material with ethanol and treatment with hydrogen peroxide, respectively, prior to the encapsulation had an additional beneficial effect on As leaching. Preliminary tests (not described herein) indicate that prior treatment with an aqueous solution of sodium hypochlorite (household bleach) will also have a beneficial effect (similar to that of treatment with aqueous $H_2O_2$).

Reasonable variations, modifications and adaptations for various conditions and uses can be made within the scope of the disclosure and appended claims.

That which is claimed is:

1. A process for encapsulating a solid waste material which contains at least one impurity selected from the group consisting of elemental arsenic, arsenic compounds, elemental mercury and mercury compounds which comprises: mixing said solid waste material with at least one liquid polysulfide polymer and at least one oxidative curing agent so as to form a mixture in which said solid waste material is essentially immersed in said at least one liquid polysulfide polymer, and thereafter maintaining said mixture at effective polymer curing conditions so as to harden said at least one liquid polysulfide polymer and to produce a solid encapsulation product; wherein said solid waste material has been extracted with at least one alcohol and thereafter substantially dried before said mixing with said at least one liquid polysulfide polymer and said at least one oxidative curing agent.

2. A process in accordance with claim 1, wherein said mixing comprises combining said at least one liquid polysulfide polymer and said at least one oxidative curing agent and then immersing said solid waste material in the thus-formed combination.

3. A process in accordance with claim 1, wherein said at least one liquid polysulfide polymer has the general chemical formula of $HS(C_2H_4—O—CH_2—O—C_2H_4SS)_x—C_2H_4—O—CH_2—O—C_2H_4SH$, wherein x is a whole number which is in the range of about 2 to about 50.

4. A process in accordance with claim 3, wherein said at least one liquid polysulfide polymer has an average molecular weight of about 1,000 to about 8,000.

5. A process in accordance with claim 3, wherein said at least one oxidative curing agent is elected from the group consisting of manganese dioxide, lead dioxide, calcium peroxide, zinc peroxide, sodium perborate, ammonium dichromate, and cumene hydroperoxide.

6. A process in accordance with claim 5, wherein said effective polymer curing conditions comprise a temperature of about 20°-80° C. and a time period of about 2-100 hours.

7. A process in accordance with claim 5, wherein said at least one curing agent is manganese dioxide, and the weight ratio of manganese dioxide to said at least one liquid polysulfide polymer is about 1:100 to about 40:100.

8. A process in accordance with claim 3, wherein said solid waste material contains at least one arsenic compound.

9. A process in accordance with claim 3, wherein said solid waste material contains arsenic and mercury compounds.

10. A process in accordance with claim 9, wherein said solid waste material contains about 0.1-10 weight-% As and about 0.001-0.01 weight-% Hg.

11. A process in accordance with claim 10, wherein said solid waste material comprises elemental sulfur and alumina.

12. A process in accordance with claim 10, wherein said solid waste material comprises copper(II) oxide, zinc oxide and alumina.

13. A process in accordance with claim 1, wherein said at least one alcohol is ethanol.

14. A process for encapsulating a solid waste material which contains at least one impurity selected from the group consisting of elemental arsenic, arsenic compounds, elemental mercury and mercury compounds which comprises: mixing said solid waste material with at least one liquid polysulfide polymer and at least one oxidative curing agent so as to form a mixture in which said solid waste material is essentially immersed in said at least one liquid polysulfide polymer, and thereafter maintaining said mixture at effective polymer curing conditions so as to harden said at least one polysulfide polymer and to produce a solid encapsulation product; wherein said solid waste material has been treated with at least one dissolved oxidizing agent and thereafter substantially dried before said mixing with said at least one liquid polysulfide polymer and said at least one oxidative curing agent.

15. A process in accordance with claim 14, wherein said at least one liquid polysulide polymer has the general chemical formula of $HS(C_2H_4—O—CH_2—O—C_2H_4SS)_x—C_2H_4—O—CH_2—O—C_2H_4SH$, wherein x is a whole number which is in the range of about 2 to about 50.

16. A process in accordance with claim 15, wherein said at least one dissolved oxidizing agent is an aqueous solution of hydrogen peroxide.

17. A process in accordance with claim 16, wherein said aqueous solution contains about 10-30 weight-% $H_2O_2$, and the treatment of said solid waste material with said aqueous solution of hydrogen peroxide is carried out at a temperature of about 20°-60° C. for a period of time of about 1 hour to about 1 day.

18. A process in accordance with claim 15, wherein said at least one dissolved oxidizing agent is an aqueous solution of sodium hypochlorite.

19. A process in accordance with claim 14, wherein said mixing comprises combining said at least on liquid polysulfide polymer and said at least one oxidative curing agent and then immersing said solid waste material in the thus-formed combination.

20. A process in accordance with claim 15, wherein said at least one liquid polysulfide polymer has an average molecular weight of about 1,000 to about 8,000.

21. A process in accordance with claim 15, wherein said at least one oxidative curing agent is elected from the group consisting of manganese dioxide, lead dioxide, calcium peroxide, zinc peroxide, sodium perborate, ammonium dichromate, and cumene hydroperoxide.

22. A process in accordance with claim 21, wherein said effective polymer curing conditions comprise a temperature of about 20°-80° C. and a time period of about 2-100 hours.

23. A process in accordance with claim 21, wherein said at least one curing agent is manganese dioxide, and the weight ratio of manganese dioxide to said at least one liquid polysulfide polymer is about 1:100 to about 40:100.

24. A process in accordance with claim 15, wherein said solid waste material contains at least one arsenic compound.

25. A process in accordance with claim 15, wherein said solid waste material contains arsenic and mercury compounds.

26. A process in accordance with claim 15, wherein said solid waste material contains about 0.1-10 weight-% As and about 0.001-0.01 weight-% Hg.

27. A process in accordance with claim 26, wherein said solid waste material comprises elemental sulfur and alumina.

28. A process in accordance with claim 26, wherein said solid waste material comprises copper(II) oxide, zinc oxide and alumina.

* * * * *